US008663425B2

(12) United States Patent
Noishiki et al.

(10) Patent No.: US 8,663,425 B2
(45) Date of Patent: Mar. 4, 2014

(54) METHOD FOR MANUFACTURING MICROFIBROUS CELLULOSE COMPOSITE SHEETS AND METHOD FOR MANUFACTURING MICROFIBROUS CELLULOSE COMPOSITE SHEET LAMINATE

(75) Inventors: Yasutomo Noishiki, Tokyo (JP); Takashi Kawamukai, Tokyo (JP); Mitsuru Tsunoda, Tokyo (JP); Yoshiyuki Asayama, Tokyo (JP)

(73) Assignee: Oji Holdings Corporation, Tokyo (JP)

( * ) Notice: Subject to any disclaimer, the term of this patent is extended or adjusted under 35 U.S.C. 154(b) by 4 days.

(21) Appl. No.: 13/384,890

(22) PCT Filed: Jul. 22, 2010

(86) PCT No.: PCT/JP2010/062334

§ 371 (c)(1),
(2), (4) Date: Jan. 19, 2012

(87) PCT Pub. No.: WO2011/013567

PCT Pub. Date: Feb. 3, 2011

(65) Prior Publication Data

US 2012/0118520 A1 May 17, 2012

(30) Foreign Application Priority Data

Jul. 31, 2009 (JP) ..... 2009-179114
Apr. 22, 2010 (JP) ..... 2010-098352

(51) Int. Cl.

| | |
|---|---|
| ***D21H 11/16*** | (2006.01) |
| ***D21H 27/36*** | (2006.01) |
| ***D21H 17/34*** | (2006.01) |
| ***D21H 27/06*** | (2006.01) |
| ***D21H 21/26*** | (2006.01) |

(52) U.S. Cl.

USPC ..... 162/157.6; 162/123; 162/127; 162/168.1; 162/182; 162/206; 162/231; 264/86; 156/307.1; 428/425.1; 428/487; 428/508

(58) Field of Classification Search

CPC ..... D21H 11/16; D21H 11/18; D21H 27/06

USPC ..... 162/103, 104, 123, 127, 132, 135, 137, 162/146, 157.6, 164.1, 164.6, 168.1, 168.2, 162/169, 182, 185, 187, 231, 206; 977/706, 977/718; 428/401, 425.1, 485, 486, 428/507–509, 511–513, 521, 534; 156/306.3, 307.1; 264/86, 87

See application file for complete search history.

(56) References Cited

U.S. PATENT DOCUMENTS

| | | | |
|---|---|---|---|
| 4,374,702 A | 2/1983 | Turbak et al. | |
| 6,103,790 A | 8/2000 | Cavaille et al. | |
| 6,787,574 B1 * | 9/2004 | Farley et al. | 516/15 |

FOREIGN PATENT DOCUMENTS

| | | |
|---|---|---|
| JP | A-56-100801 | 8/1981 |
| JP | A-57-061035 | 4/1982 |
| JP | A-05-148387 | 6/1993 |
| JP | A-08-188980 | 7/1996 |
| JP | A-08-188981 | 7/1996 |
| JP | A-09-078496 | 3/1997 |
| JP | A-09-216952 | 8/1997 |
| JP | T-09-509694 | 9/1997 |
| JP | A-10-248872 | 9/1998 |
| JP | A-11-209401 | 8/1999 |
| JP | B-3036354 | 4/2000 |
| JP | A-2001-279016 | 10/2001 |
| JP | A-2004-270064 | 9/2004 |
| JP | A-2005-060680 | 3/2005 |
| JP | B-3641690 | 4/2005 |
| JP | A-2006-193858 | 7/2006 |
| JP | A-2006-316253 | 11/2006 |
| JP | A-2007-023218 | 2/2007 |
| JP | A-2007-023219 | 2/2007 |
| JP | A-2008-106152 | 5/2008 |
| JP | A-2008-127693 | 6/2008 |
| JP | A-2008-169497 | 7/2008 |
| JP | A-2008-248441 | 10/2008 |
| JP | A-2008-274525 | 11/2008 |
| WO | WO 2011/010609 A1 | 1/2011 |

OTHER PUBLICATIONS

JP 2008-248441, Oct. 2008, English language machine translation [retrieved from http://www.ipdl.inpit.go.jp/homepg_e.ipdl].*
JP 2006-316253, Nov. 2006, English language machine translation [http://www.ipdl.inpit.go.jp/homepg_e.ipdl].*

* cited by examiner

*Primary Examiner* — Eric Hug
(74) *Attorney, Agent, or Firm* — Knobbe Martens Olson & Bear LLP

(57) ABSTRACT

The present invention provides a method for easily and efficiently manufacturing microfibrous cellulose composite sheets. The present invention is a method for manufacturing microfibrous cellulose composite sheets, including a preparation process in which a polymer emulsion is mixed with an aqueous suspension including microfibrous cellulose, thereby preparing a mixed fluid, a papermaking process in which the mixed fluid is dehydrated on a porous base material through filtration, and a sheet including moisture is formed, and a drying process in which the sheet including moisture is heated and dried. In addition, the present invention is a method for manufacturing a microfibrous cellulose composite sheet laminate, in which the microfibrous cellulose sheets are thermally compressed and thus laminated as they are or after being provided with a polymer layer on at least one surface thereof.

12 Claims, No Drawings

METHOD FOR MANUFACTURING MICROFIBROUS CELLULOSE COMPOSITE SHEETS AND METHOD FOR MANUFACTURING MICROFIBROUS CELLULOSE COMPOSITE SHEET LAMINATE

This application is the U.S. National Phase under 35 U.S.C. §371 of International Application PCT/JP2010/062334, filed Jul. 22, 2010, designating the U.S., and published in Japanese as WO 2011/013567 on Feb. 3, 2011, which claims priority to Japanese Patent Application No. 2009-179114, filed Jul. 31, 2009, and to Japanese Patent Application No. 2010-098352, filed Apr. 22, 2010, the entire contents of which are incorporated herein by reference.

TECHNICAL FIELD

An object of the present invention is to provide a method for manufacturing microfibrous cellulose composite sheets in which microfibrous cellulose is efficiently made into a polymer, and a composite.

In addition, another object of the present invention is to provide a method in which microfibrous cellulose and a composite sheet of a polymer are efficiently made into a laminate.

Priority is claimed on Japanese Patent Application No. 2009-179114, filed Jul. 31, 2009, and Japanese Patent Application No. 2010-098352, filed Apr. 22, 2010, the content of which is incorporated herein by reference.

BACKGROUND ART

In recent years, nanotechnologies have been gaining attention, and aim to produce different properties from those on a bulk or molecular level by making substances of nanometer size. Meanwhile, the application of recyclable natural fibers has also received increasing attention for substitution of petroleum resources and due to increasing environmental consciousness.

Among natural fibers, a cellulose fiber, particularly, a tree-derived cellulose fiber (pulp), is widely used mainly as a paper product. The width of the cellulose fiber that is used for paper is mostly 10 μm to 50 μm. Paper (sheets) obtained from the cellulose fiber is opaque, and, due to its opaqueness, is widely used as printing paper. Meanwhile, a cellulose fiber is treated (beaten or crushed) using a refiner or kneader, a sand grinder, and the like, and micronized (micro-fibrillation), thereby producing transparent paper (glassine paper or the like). However, the transparency of the transparent paper is on a semi-transparent level, the permeability of light rays is poor compared with a polymer film, and the degree of cloudiness (base value) is also large.

In addition, since the cellulose fiber is a collection of cellulose crystals having a high modulus of elasticity and a low coefficient of thermal expansion, and the thermal-resistant dimensional stability is improved by making the cellulose fiber into a composite with a polymer, the cellulose fiber is used for a laminate and the like. However, since the ordinary cellulose fiber is a collection of crystals, and has a tubular space therein, the cellulose fiber has a limitation with regard to the dimensional stability.

A water dispersion of microfibrous cellulose that is produced by mechanically crushing a cellulose fiber so as to be 50 nm or less in the fiber width is transparent. Meanwhile, while a microfibrous cellulose sheet includes spaces, irregularly reflects light rays so as to look white, and has an increasing opaqueness, when a resin is impregnated in the microfibrous cellulose sheet, the spaces are filled, and therefore a transparent sheet can be obtained. Furthermore, since the fibers of the microfibrous cellulose sheet are a collection of cellulose crystals, are extremely rigid, and have a small width, the number of fibers is markedly increased in the same mass compared with an ordinary cellulose sheet (paper). Therefore, when the microfibrous cellulose is made into a composite with a polymer, microfibers are more evenly and densely dispersed in the polymer, and the thermal-resistant dimensional stability is extremely improved. In addition, the fibers are fine, and thus the transparency is high. There are extremely high expectations for the composite of the microfibrous cellulose having the above characteristics to act as a flexible transparent substrate (a transparent substrate that can be bent and folded) for organic ELs and liquid crystal displays.

A number of techniques for micronizing microfibrous cellulose and techniques for making microfibrous cellulose into a composite with a polymer are disclosed, but only few techniques are disclosed in which microfibrous cellulose is made into a composite sheet while maintaining the industrial productivity.

Specifically, Patent Documents 1 to 3 disclose techniques for making a cellulose fiber into a microfibrous fiber, but these documents do not disclose or propose techniques for making the microfibrous cellulose into a sheet and, at the same time, making the microfibrous cellulose into a composite with a polymer.

Patent Documents 4 to 10 disclose techniques and the like in which properties, such as dynamic strength, are improved by forming a composite of microfibrous cellulose in a polymer resin, but disclose only few techniques for easing the formation of the composite.

In addition, Patent Documents 10 to 20 disclose techniques for making microfibrous cellulose into a sheet, but fail to secure the productivity on an industrial level, and thus there is a demand for provision of a simple method for making microfibrous cellulose into a composite sheet in a complex with a polymer, and a simple method for laminating the composite sheets.

CITATION LIST

Patent Documents

[Patent Document 1] JP-A-56-100801
[Patent Document 2] JP-A-2008-169497
[Patent Document 3] Japanese Patent No. 3036354
[Patent Document 4] Japanese Patent No. 3641690
[Patent Document 5] JP-T-9-509694
[Patent Document 6] JP-A-2006-316253
[Patent Document 7] JP-A-9-216952
[Patent Document 8] JP-A-11-209401
[Patent Document 9] JP-A-2008-106152
[Patent Document 10] JP-A-2005-060680
[Patent Document 11] JP-A-8-188981
[Patent Document 12] JP-A-2006-193858
[Patent Document 13] JP-A-2008-127693
[Patent Document 14] JP-A-5-148387
[Patent Document 15] JP-A-2001-279016
[Patent Document 16] JP-A-2004-270064
[Patent Document 17] JP-A-8-188980
[Patent Document 18] JP-A-2007-23218
[Patent Document 19] JP-A-2007-23219
[Patent Document 20] JP-A-10-248872

SUMMARY OF THE INVENTION

Problem to be Solved by the Invention

The present invention provides a method for manufacturing microfibrous cellulose composite sheets, which includes a process in which a polymer emulsion is mixed with an aqueous suspension including microfibrous cellulose, the mixed fluid is dehydrated on a porous base material through filtration, and then dried.

In addition, the present invention provides a method in which two or more of the microfibrous cellulose composite sheets are overlapped, or a polymer layer is formed on at least one surface of the microfibrous cellulose composite sheet, and thermally compressed, thereby manufacturing a laminate.

Means for Solving the Problem

The present inventors carried out a variety of studies regarding whether or not it is possible to efficiently form a polysaccharide material including a lot of water into a composite sheet by a method in which a polymer emulsion is mixed with an aqueous suspension including microfibrous cellulose, the mixed fluid is dehydrated on a porous base material through filtration, and then dried, and completed the present invention based on relevant findings.

In addition, the inventors carried out a variety of studies regarding whether or not a laminate can be manufactured using the above composite sheets as they are, or by further forming a polymer layer on at least one surface of the composite sheets, laminating and thermally pressing two or more of the sheets, and completed the present invention based on relevant findings.

The present invention includes each of the following inventions.

(1) A method of manufacturing microfibrous cellulose composite sheets, which is a method for manufacturing a composite sheet using microfibrous cellulose, including a preparation process in which a polymer emulsion is mixed with an aqueous suspension including microfibrous cellulose so as to manufacture a mixed fluid, a papermaking process in which the mixed fluid is dehydrated on a porous base material through filtration, and a sheet including moisture is formed, and a drying process in which the sheet including moisture is heated and dried.

(2) The method of manufacturing microfibrous cellulose composite sheets according to the above (1), in which the solid content concentration of the mixed fluid is 3% by mass or less.

(3) The method of manufacturing microfibrous cellulose composite sheets according to the above (1) or (2), in which the polymer emulsion is formed of at least one polymer selected from the group consisting of polyurethane, polyethylene, alkyl(meth)acrylate ester copolymers, acid-denatured styrene-butadiene copolymers, and polypropylene.

(4) The method of manufacturing microfibrous cellulose composite sheets according to any one of the above (1) to (3), in which the polymer emulsion is cationic.

(5) The method of manufacturing microfibrous cellulose composite sheets according to any one of the above (1) to (4), in which a cellulose coagulant is mixed in the mixed fluid including microfibrous cellulose in the preparation process.

(6) The method of manufacturing microfibrous cellulose composite sheets according to any one of the above (1) to (5), in which the fiber width of the mixing microfibrous cellulose is 2 nm to 1000 nm in the preparation process.

(7) A method of manufacturing a microfibrous cellulose composite sheet laminate, which is a method of manufacturing a microfibrous cellulose composite sheet laminate, including a process in which two or more of the microfibrous cellulose composite sheets obtained by the method for manufacturing a microfibrous cellulose composite sheet according to any one of the above (1) to (6) are overlapped, and a process in which the overlapped microfibrous cellulose composite sheets are thermally compressed.

(8) The method of manufacturing a microfibrous cellulose composite sheet laminate according to the above (7), further including a process in which a polymer layer is provided on at least one surface of at least one of the microfibrous cellulose composite sheets.

(9) The method of manufacturing a microfibrous cellulose composite sheet laminate according to the above (7), in which at least one of the microfibrous cellulose composite sheets is a microfibrous cellulose composite sheet provided with a polymer layer on at least one surface.

(10) The method of manufacturing a microfibrous cellulose composite sheet laminate according to the above (8) or (9), in which the polymer layer has the same composition as the polymer emulsion contained in the microfibrous cellulose composite sheet.

(11) The method of manufacturing a microfibrous cellulose composite sheet laminate according to any one of the above (8) to (10), in which the polymer layer is obtained by applying, heating, and drying the polymer emulsion.

Effects of the Invention

According to the present invention, it is possible to provide a manufacturing method in which a microfibrous cellulose composite sheet can be produced extremely efficiently.

In addition, according to the present invention, it is possible to provide a manufacturing method in which a laminate of microfibrous cellulose composite sheets can be produced extremely efficiently.

EMBODIMENTS OF THE INVENTION

Hereinafter, the present invention will be described in detail.

The microfibrous cellulose in the present invention is a cellulose fiber or a rod-shaped particle having a far smaller width than a pulp fiber that is used for ordinary paper-manufacturing. The microfibrous cellulose is a collection of cellulose molecules in a crystal state, and the crystal structure thereof is the I-type (parallel chain). The width of the microfibrous cellulose is preferably 2 nm to 1000 nm, more preferably 2 nm to 500 nm, and still more preferably 4 nm to 100 nm under electron microscope observation. When the width of the fiber is less than 2 nm, the cellulose is dissolved in water in a molecular form, and therefore it becomes difficult for the cellulose to exhibit the properties (strength or rigidity, or dimensional stability) as a microfiber. When the width of the fiber exceeds 1000 nm, since the cellulose cannot be called a microfiber, and is simply a fiber included in ordinary pulp, the properties (strength or rigidity, or dimensional stability) as a microfiber cannot be obtained. In addition, when there is a demand for transparency in the composite of the microfibrous cellulose, the width of the microfiber is preferably 50 nm or less.

Here, the fact that the microfibrous cellulose has the I-type crystal structure can be identified from the fact that the microfibrous cellulose has typical peaks at two locations in the vicinity of $2\theta=14°$ to $17°$ and $2\theta=22°$ to $23°$ in a diffraction profile obtained from a wide-angle X-ray diffraction photograph that is monochromatized by graphite and uses CuKα (λ=0.15418 nm). In addition, the fiber width of the microfibrous cellulose is measured through an electron microscope observation in the following manner. An aqueous suspension of microfibrous cellulose having a concentration of 0.05% by mass to 0.1% by mass is prepared, and the suspension is cast on a grid coated with a hydrophilized carbon film, thereby producing a TEM observation specimen. In a case in which the microfibrous cellulose includes wide fibers, a SEM image of the surface cast on a glass plate may be observed. Observation is carried out using electron microscope photographs at a magnification of any of 5000 times, 10000 times, and 50000 times depending on the width of the composing fiber. At this time, specimens and the observation conditions (magnification and the like) are set so that at least 20 or more fibers intersect the axes in a case in which vertical and horizontal axes having the image width are arbitrarily supposed in the obtained image. Two vertical axes and two horizontal axes are randomly drawn on a piece of the observation image that satisfies the conditions, and the fiber widths of fibers that intersect the axes are visually scanned. A minimum of 3 pieces of image of an non-overlapped surface portion are observed using an electron microscope in the above manner, and the values of the fiber widths of fibers that intersect two axes respectively are scanned (a minimum of 20 fibers×2×3=120 fibers' widths).

The method for manufacturing microfibrous cellulose is not particularly limited, but a method in which cellulose-based fibers are made finer through wet crushing in which a mechanical operation, such as a grinder (an ultra-fine friction grinder), a high-pressure homogenizer or ultrahigh-pressure homogenizer, a high-pressure impact grinder, a disc-type refiner, or a conical refiner, is used is preferred. In addition, cellulose-based fibers may also be micronized by carrying out a chemical treatment, such as TEMPO oxidation, an ozone treatment, or an enzyme treatment. The micronizing cellulose-based fiber includes plant-derived cellulose, animal-derived cellulose, bacteria-derived cellulose, or the like. More specifically, the micronizing cellulose-based fiber includes tree-based paper-manufacturing pulp, such as softwood pulp or hardwood pulp, cotton-based pulp, such as cotton linter or cotton lint, non-tree-based pulp, such as linen, wheat straw, or bagasse, cellulose isolated from sea squirt, marine plants, or the like. Among them, tree-based paper-manufacturing pulp or non-tree-based pulp is preferred from the standpoint of ease of procurement.

In the present invention, a mixture of a polymer emulsion with an aqueous suspension obtained by suspending the microfibrous cellulose in water is used.

Here, the polymer emulsion refers to an emulsion in which a natural or synthetic polymer is dispersed as a dispersion medium and a milk white liquid in which fine polymer particles having a particle diameter of approximately 0.001 μm to 10 μm are dispersed in water. The polymer emulsion is manufactured by ordinary emulsion polymerization, and sometimes called a polymer latex. The emulsion polymerization is one type of radical polymerization, and is basically a polymerization method in which a monomer that is poorly soluble in an aqueous medium and an emulsifier are mixed in the medium, and a polymerization initiator that is soluble in the medium is added.

The polymer emulsion is not particularly limited, but the dispersion media of the emulsion include resin emulsions, such as polystyrene, polyvinyl chloride, polyvinylidene chloride, polyvinyl acetate, ethylene-vinyl acetate copolymers, alkyl poly(meth)acrylate esters, alkyl(meth)acrylate ester copolymers, poly(meth)acrylonitrile, polyesters, and polyurethanes; natural rubber; styrene-butadiene copolymers, styrene-butadiene copolymers in which the molecular chain terminal is denatured with at least one functional group selected from the group of —SH, —CSSH, —$SO_3H$, —$(COO_x)M$, —$(SO_3)_xM$, and —CO—R (meanwhile, in the functional groups, M represents a cation, x represents an integer of 1 to 3, which is dependent on the valence of M, and R is an alkyl group); acid-, amine-, amide-, acryl-, and other-denatured styrene-butadiene copolymers; (meth)acrylonitrile-butadiene copolymers; polyisoprene; polychloroprene; styrene-butadiene-methyl methacrylate copolymers; styrene-alkyl(meth)acrylate ester copolymers; and the like.

In addition, the dispersion media of the polymer resin, such as polyethylene, polypropylene, polyurethane, and ethylene-vinyl acetate copolymers, may be emulsified by post emulsification, and may be used as the polymer emulsion in the present invention.

Preferred dispersion media that form the polymer emulsion of the present invention include polyurethane, polyethylene, alkyl(meth)acrylate ester copolymers, acid-denatured styrene-butadiene copolymers, and polypropylene.

The method for manufacturing the polymer emulsion will be described.

Firstly, for the polymer emulsion used in the present invention, a polymer having a sufficient capability of stabilizing emulsion particles, which are generated by emulsifying a radical-polymerizable monomer in water using an emulsifier and polymerizing the monomer, in water is used as the dispersion medium.

The method for manufacturing the polymer emulsion is pursuant to a traditional emulsion polymerization method in the related art. That is, a radical-polymerizable monomer (emulsified substance) is radical-polymerized in an appropriate aqueous medium in the presence of a polymerization initiator, such as a peroxide or an azo compound, and a chain transfer agent, such as a thiol compound or a disulfide compound.

In the polymer emulsion, the emulsifier is mixed in a range of 0.1% by mass to 6% by mass with respect to the total monomers. When the mixed amount is less than 0.1% by mass, polymerization stability becomes insufficient, and there is a concern that an agglomerate may be generated during the reaction. In addition, when the mixed amount exceeds 6% by mass, the particle diameter of the polymer emulsion is excessively decreased, and the viscosity is increased, which are not preferred.

Examples of the emulsifier that is used in the invention include anionic emulsifiers, such as potassium oleate, sodium laurate, sodium dodecylbenzenesulfonate, sodium alkyl naphthalene sulfonate, sodium dialkyl sulfosuccinate, sodium polyoxyethylene alkyl ether sulfate, sodium polyoxyethylene alkylaryl ether sulfate, sodium-polyoxy ethylene dialkyl sulfate, polyoxyethylene alkyl ether phosphate ester, and polyoxyethylene alkylaryl ether phosphate ester, and, furthermore, non-ionic emulsifiers, such as polyoxyethylene alkyl ether, polyoxyethylene alkylaryl ether, poly(oxyethylene-oxypropylene) block copolymers, polyethylene glycol aliphatic ester, and polyoxy ethylene sorbitan aliphatic ester. In addition, examples thereof include cationic emulsifiers, such as quaternary ammonium salts, such as an alkyl trimethyl ammonium salt, a dialkyl dimethyl ammonium salt, an alkyl dimethyl benzyl ammonium salt, an acylaminoethyl diethyl ammonium salt, an acylaminoethyl diethylamine salt, an alkylamide propyl dimethyl benzyl ammonium salt, an alkyl pyridinium salt, an alkyl pyridinium sulfate, a stearamide methyl pyridinium salt, an alkyl quinolinium salt, an alkyl isoquinolinium salt, an aliphatic acid polyethylene polyamide, an acylamino ethyl pyridinium salt, and an acyl aminoformyl methyl pyridinium salt, ester-bonded amines or ester-bonded quaternary ammonium salts, such as a stearoxy methyl pyridinium salt, aliphatic triethanol amine, aliphatic triethanol amine formate, trioxy-ethylene aliphatic triethanol-amine, a cetyloxy methyl pyridinium salt, or a p-isooctyl phenoxy ethoxy ethyl dimethyl benzyl ammonium salt, heterocyclic amines, such as alkyl-imidazoline, 1-hydroxyethyl-2-alkylimidazoline, 1-acetylamino ethyl-2-alkyimidazoline, or 2-alkyl-4-methyl-4-hydroxymethyloxazoline, amine derivatives, such as polyoxy ethylene alkyl amine, N-alkyl propylene diamine, N-alkyl polyethylene polyamine, N-alkyl polyethylene polyamine dimethyl sulfate, alkyl biguanide, or a long chain amine oxide.

In addition, examples thereof include amphoteric emulsifiers, such as lauryl dimethyl amine oxide, lauryl betaine, stearyl betaine, 2-alkyl-N-carboxy methyl-N-hydroxy ethyl imidazolinium betaine, and lecithin. Furthermore, a polymer compound having an emulsion dispersion capability and a relatively low molecular weight, for example, a polyvinyl alcohol, a denatured substance thereof, a polyacryl amide, a polyethylene glycol derivative, a neutralized substance of a polycarboxylic acid copolymer, casein, or the like may be used singly or jointly with the emulsifier.

The appropriate concentration of the monomer during the polymerization is generally about 30% by mass to 70% by mass, and preferably about 40% by mass to 60% by mass. In addition, examples of the polymerization initiator that can be used during the polymerization include peroxide compounds, such as benzoyl peroxide, lauroyl peroxide, t-butyl hydroperoxide, paramenthane hydroperoxide, diisopropyl benzene hydroperoxide, 1,1,3,3-tetramethyl butyl hydroperoxide, dicumyl peroxide, cyclohexane peroxide, succinic acid peroxide, potassium persulfate, ammonium persulfate, or hydrogen peroxide, or azo compounds, such as 2,2'-azobis(4-methoxy-2,4-dimethyl valeronitrile), 2,2'-azobis(2,4-dimethyl valeronitrile), 2,2'-azobis(2-methyl propionitrile), 2,2'-azobis(2-methyl-butyronitile), 1,1'-azobis(cyclohexane-1-carbonitrile), 1-[(1-cyano-1-methylethyl)azo]form-amide, dimethyl 2,2'-azobis(2-methylpropionate), 4,4'-azobis(4-cyanovaleric acid), 2,2'-azobis(2,4,4-trimethyl-pentane), 2,2'-azobis[2-methyl-N-[1,1'-bis(hydroxyl methyl)-2-hydroxy ethyl]propion-amide], 2,2'-azobis{2-(2-imidazoline-2-yl) propane]dihydrochloride, 2,2'-azobis{2-(2-imidazoline-2-yl)propane]disulfate dehydrate, 2,2'-azobis[2-[1-(2-hydroxy-ethyl)-2-imidazoline-2-yl)propane]]dihydrochloride, 2,2'-azobis(1-imino-1-pyrolidino-2-methylpropane)dihydrochloride, 2,2'-azobis(2-methyl-propion-amindine)dihydrochloride, or 2,2'-azobis[N-(2-carboxy ethyl)-2-methyl-propion-amidine]tetrahydrate.

When the polymer is polymerized, the aqueous medium can be appropriately selected from water or a mixture of water and ethers, such as tetrahydrofuran, dioxane, or dimethoxyethane, ketones, such as methyl ethyl ketone, methyl isobutyl ketone, or acetone, aromatic substances, such as toluene, benzene, or chlorobenzene, halogenated hydrocarbons, such as dichloromethane, 1,1,2-trichloroethane, or dichloroethane, alcohols, such as isopropanol, ethanol, methanol, or methoxy-ethanol, or esters, such as ethyl acetate.

Specific examples of the monomer that is used in the present invention and composes the polymer emulsion include ethylenic unsaturated carboxylic acid-containing monomers, such as (meth)acrylic acid, crotonic acid, maleic acid, itaconic acid, fumaric acid, monoalkyl maleate, or monoalkyl fumarate, methyl (meth)acrylate, ethyl (meth) acrylate, propyl(meth)acrylate, butyl (meth)acrylate, hexyl (meth)acrylate, octyl(meth)acrylate, 2-ethylhexyl(meth) acrylate, lauryl(meth)acrylate, stearyl(meth)acrylate, vinyl acetate, vinyl chloride, vinylidene chloride, (meth)acrylonitrile, styrene, ethylene, propylene, butadiene, isoprene, chloroprene, 2-hydroxy-ethyl (meth)acrylate, 2-hydroxypropyl (meth)acrylate, 2-hydroxy-butyl (meth)acrylate, polyethylene glycol(meth)acrylate, 2-hydroxy-3-phenoxypropyl(meth)acrylate, glycerol mono(meth)acrylate, ethylene glycol di(meth)acrylate, diethylene glycol di(meth)acrylate, triethylene glycol di(meth)acrylate, polyethylene glycol di(meth)acrylate, dipropylene glycol di(meth)acrylate, 1,3-butylene glycol di(meth)acrylate, trimethylol-propane tri (meth)acrylate, tetramethylol-methane tetra(meth)acrylate, divinyl-benzene, 1,4-butanediol di(meth)acrylate, 1,6-hexanediol di(meth)acrylate, glycidyl(meth)acrylate, methyl glycidyl(meth)acrylate, N-methylol(meth)acryl-amide, N-methoxy methyl(meth)acryl-amide, N-butoxy methyl (meth)acryl amide, or N,N-methylene bis(meth)acryl-amide, or at least one of the above can be used.

The chain transfer agent that can be used includes mercaptans, such as n-dodecyl mercaptan, octyl mercaptan, t-butyl mercaptan, thioglycolic acid, thiomalic acid, and thiosalicylic acid, sulfides, such as diisopropyl xanthogen disulfide, diethyl xanthogen disulfide, and diethyl thiuram disulfide, halogenated hydrocarbons, such as iodoform, diphenyl ethylene, p-chlorodiphenyl ethylene, p-cyano diphenyl ethylene, α-methyl styrene dimer, or sulfur.

The polymerization inhibitor that can be used includes phenothiazine, 2,6-di-t-butyl-4-methyl-phenol, 2,2'-methylene bis(4-ethyl-6-t-butyl-phenol), tris(nonylphenyl)phosphite, 4,4'-thio bis(3-methyl-6-t-butylphenol), N-phenyl-1-naphthylamine, 2,2'-methylene bis(4-methyl-6-t-butylphenol, 2-mercaptobenzimidazole, hydroquinone, or N,N-diethyl hydroxyl-amine.

The polymerization reaction is carried out at a reaction temperature of, generally, about 40° C. to 95° C., and, preferably 60° C. to 90° C. for 1 hour to 10 hours, and preferably for about 4 hours to 8 hours. The monomer can be added by a method such as the monomer tap method or the monomer pre-emulsion tap method, the batch addition method, the split addition method, the continuous addition method, or the like. Preferably, the monomer is added by the monomer pre-emulsion tap method in the continuous addition method.

The concentration of the polymer emulsion obtained in the above manner is preferably adjusted to 20% by mass to 65% by mass, and preferably to about 30% by mass to 60% by mass.

In a case in which a monomer containing a carboxylic group, a sulfo group, and the like is copolymerized in a copolymer of the polymer emulsion (latex), the polymer emulsion may be neutralized by an appropriate alkali substance, such as sodium hydroxide, potassium hydroxide, ammonium, and a variety of primary, secondary, and tertiary amines, and thus stabilized.

Next, a method for emulsifying the polymer resin by the post emulsification will be described.

There is a variety of known methods for manufacturing a dispersion fluid in which a thermoplastic resin, such as polyethylene, polypropylene, an ethylene-vinyl acetate copolymer resin, or the like, is dispersed in water using a dispersant, such as an emulsifier and a protective colloid agent, which is a so-called emulsion.

For example, in the case of the ethylene-vinyl acetate copolymer, as described in JP-A-57-61035, firstly, the ethylene-vinyl acetate copolymer is heated and melted, subsequently, the anionic or non-ionic emulsifier described above is added and stirred, then, hot water is added, the ethylene-vinyl acetate copolymer is emulsified by a shear force of a machine, such as a homo mixer, and obtained.

In addition, a number of water-soluble or water-dispersible polyurethane emulsions are known. One example thereof is a thermal reaction-type polyurethane emulsion in a relatively low to intermediate molecular weight region, for which a blocked isocyanate group is used. Another example thereof is a thermoplastic polyurethane emulsion in a relatively high molecular weight region, which is mainly straight chain-structured. They are obtained either by introducing an anionic, cationic, or non-ionic hydrophilic group to a polyurethane skeleton so that the hydrophilic group is emulsified or dispersed by itself, or by adding the emulsifier to a hydrophobic resin so that the hydrophobic resin is forcibly dispersed in water.

In the present invention, a larger particle diameter of the polymer emulsion is preferred in consideration of the yield rate or dewaterability when an aqueous suspension of microfibrous cellulose and the polymer emulsion are mixed with each other and made into a sheet, but there is a concern that the uniformity and optical properties of the sheet may be degraded when the particle diameter is too large, and therefore the particle diameter of the polymer emulsion is preferably 0.001 μm to 10 μm, which is a purpose-matched appropriate size. Among them, it is advantageous that the polymer emulsion have cationic surface charges in terms of the dispersion stability, yield rate, and the like.

The method for making the polymer emulsion cationic includes a method in which a cationic monomer is copolymerized, and a method in which the dispersion medium of an emulsion is polymerized using a cationic emulsifier.

The method for making the polymer emulsion cationic using polyurethane as an example of the dispersion medium of the emulsion will be specifically described. A first method for making a urethane prepolymer cationic is a method in which an active hydrogen compound having a tertiary amino group is caused to react in the urethane prepolymer, thereby introducing a tertiary amine group. An arbitrary active hydrogen compound may be used as the active hydrogen compound having a tertiary amine group. Preferred active hydrogen compounds include aliphatic compounds having an active hydrogen-containing group, such as a hydroxyl group or a primary amino group, or a tertiary amino group, for example, N-dimethyl ethanol amine, N-methyl-diethanol-amine, N,N-dimethyl-ethylene-diamine, and the like. In addition, N,N,N-trimethylol-amine or N,N,N-triethanol-amine, which are tertiary amines, can also be used. Among them, a polyhydroxy compound having a tertiary amino group and containing two or more active hydrogen atoms that are reactive with an isocyanate group is preferred.

The amine equivalent weight value of the urethane polymer to which the tertiary amino group is introduced is preferably 10 mg KOH/g or more. When the amine equivalent weight value (since this represents the total weight of primary, secondary, and tertiary amines, this refers to the milligrams of KOH having the equivalent weight of hydrochloric acid that is necessary to neutralize 1 g of the sample) is 10 mg KOH/g or more, it is possible to make the urethane polymer sufficiently hydrophilic.

The active hydrogen-containing group in the active hydrogen compound having the tertiary amino group and the isocyanate group in the urethane prepolymer are caused to react with each other so that the active hydrogen compound having a tertiary amino group is bonded to the urethane prepolymer. After that, when the tertiary amino group is quaternized using a quaternizing agent, an aqueous cationic urethane prepolymer can be obtained.

Dimethyl sulfate or diethyl sulfate is preferably used as the quaternizing agent since they are non-chlorine-based.

In addition, without being quaternized, the tertiary amino group can be neutralized by an acid, and made into a salt, thereby being water-soluble. Preferred neutralizers include organic acids, such as acetic acid, oxalic acid, malonic acid, succinic acid, malic acid, citric acid, pentanedioic acid, adipic acid, and maleic acid, and inorganic acids, such as phosphoric acid and nitric acid.

A second method for making the urethane prepolymer cationic is a method in which a cationic compound is mixed with the urethane prepolymer, and the urethane prepolymer is charged to be cationic. In this case, the amine equivalent weight of the urethane prepolymer is preferably 10 mg KOH/g or less, and may be 0 mg KOH/g.

Examples of the cationic compound include cationic emulsifiers having a quaternary ammonium salt. Specific examples thereof include dicyan-diamide-based compounds, such as an alkyl trimethyl ammonium salt, an alkyl dimethyl benzyl ammonium salt, an alkyl pyridinium salt, or a dicyan-diamide-diethylene triamine condensate.

The urethane prepolymer can be made cationic by emulsifying the urethane prepolymer in water using an emulsifier including a cationic compound.

In addition, the urethane prepolymer can also be made cationic by causing a polyhydroxy compound having a tertiary amino group and containing at least two or more active hydrogen atoms that are reactive with an isocyanate group to react with the urethane prepolymer, and, furthermore, emulsifying the polyhydroxy compound in water using an emulsifier including a cationic compound.

After the urethane prepolymer is made cationic in the above manner, water is added to the urethane prepolymer so that the isocyanate group is crosslinked (a urea bond is formed) while the urethane prepolymer is made water-based (dissolved or dispersed in water). The content of the isocyanate group in the urethane prepolymer is preferably in a range of 1% by mass to 5% by mass. When the isocyanate group is within this range, the urethane prepolymer is easily prepared, the cohesive force of the obtained polyurethane does not become excessive, and an excellent texture can be provided to the obtained composite sheet.

Instead of water, a multivalent amine having two or more active hydrogen atoms in one molecule may be added so that the isocyanate group is crosslinked with the amine while the urethane prepolymer is emulsified in water.

Examples of the multivalent amine having two or more active hydrogen atoms in one molecule include ethylene diamine, propylene diamine, diethylene triamine, hexylene amine, triethylene tetramine, tetraethylene pentamine, isophorone diamine, peperazine, diphenyl-methane diamine, hydrazine, and adipic dihydrazide.

When a chain extension reaction of the cationic urethane prepolymer is caused while the cationic urethane prepolymer is emulsified by adding water or the multivalent amine as described above, and then the solvent is removed, an emulsion of the polyurethane can be obtained.

The concentration of the polymer emulsion used in the present invention can be arbitrarily changed in a range of about 20% by mass to 65% by mass; however, when the basis weight of a cellulose sheet is decreased, trapping by fibers is removed, and there is a concern that the yield rate may be extremely degraded.

The mixed fluid including the microfibrous cellulose that is used in the present invention is prepared by injecting and stirring the polymer emulsion in the microfibrous cellulose aqueous suspension. Using an apparatus, such as an agitator, a homogenizer, or a pipe line mixer, as a stirring apparatus, the polymer emulsion and the microfibrous cellulose aqueous suspension are uniformly mixed and stirred.

In the present invention, it is preferable to mix a cellulose coagulant with the mixed fluid in the preparation process. The cellulose coagulant includes water-soluble organic compounds including a water-soluble inorganic salt or a cationic functional group. The water-soluble inorganic salts include sodium chloride, calcium chloride, potassium chloride, ammonium chloride, magnesium chloride, aluminum chloride, sodium sulfate, potassium sulfate, aluminum sulfate, magnesium sulfate, sodium nitrate, calcium nitrate, sodium carbonate, potassium carbonate, ammonium carbonate, sodium phosphate, ammonium phosphate, and the like.

The water-soluble organic compounds including a cationic functional group include polymers and the like, which are polymerized or co-polymerized monomers containing polyacryl-amide, polyvinyl-amine, a urea resin, a melamine resin, a melamine-formaldehyde resin, and a quaternary ammonium salt.

The mixed amount of the cellulose coagulant needs to be an amount or more that can gelatinize the aqueous suspension. Specifically, it is preferable to add 0.5 parts by mass to 10 parts by mass of the cellulose coagulant with respect to 100 parts by mass of the microfibrous cellulose. When the mixed amount of the cellulose coagulant is less than 0.5 parts by mass, the aqueous suspension is not sufficiently gelatinized, and there is a concern that the effect for improving the water-filtering properties may become poor. When the mixed amount exceeds 10 parts by mass, the aqueous suspension is excessively gelatinized, and there is a concern that it may become difficult to handle the aqueous suspension. The mixed amount of the cellulose coagulant is more preferably in a range of 1 part by mass to 8 parts by mass. Here, the gelatinization by the present invention refers to a state change in which the viscosity of the aqueous suspension is abruptly and significantly increased, and the fluidity is lost. However, the obtained gel has a jelly-like form, and is easily broken by stirring. Whether or not the aqueous suspension is gelatinized can be visually determined since the aqueous suspension is in a state in which the fluidity is abruptly lost, but whether or not the aqueous suspension of the microfibrous cellulose includes the cellulose coagulant of the present invention is determined using the B-type viscosity at a concentration of 0.5% by mass and a temperature of 25° C. (rotor No. 4, rotating speed: 60 rpm). The viscosity is preferably 1000 mPa·s or more, more preferably 2000 mPa·s or more, and particularly preferably 3000 mPa·s or more. When the B-type viscosity is less than 1000 mPa·s, the aqueous suspension is not sufficiently gelatinized, and there is a concern that the effect for improving the water-filtering properties may become poor.

In addition, it is preferable to use a weakly cationic compound as the cellulose coagulant when transparency is required. The weakly cationic compound includes ammonium carbonate-based compounds, such as ammonium carbonate or ammonium hydrogen carbonate, or organic carboxylic acid ammonium-based compounds, such as ammonium formate, ammonium acetate, or ammonium propionate. Among them, ammonium carbonate or ammonium hydrogen carbonate, which is heated to 60° C. or higher, decomposed, vaporized, and discharged from a sheet, is preferred.

Furthermore, fine cation resins for which the degree of cationization measured by the colloid titration method is 1.0 meq/g to 3.0 meq/g, for example, organic polymers, such as, a polyamide compound, a polyamide-polyurea compound, a polyamine-polyurea compound, a polyamide amine polyurea compound, or a polyamide amine compound, can be used. Commercially available products include SPI-203 (denatured amine-based resin, manufactured by Taoka Chemical Co., Ltd.), SPI-106N (denatured polyamide-based resin, manufactured by Taoka Chemical Co., Ltd.), SPI-102A (denatured polyamide-based resin, manufactured by Taoka Chemical Co., Ltd.), and the like.

(Colloid Titration Method)

The colloid titration method used to measure the degree of cationization is a titration method of a polymer electrolyte, which is proposed by Hiroshi Terayama, a faculty member of Science, University of Tokyo, and the principle thereof is based on the fact that a polycation and a polyanion are ionically bonded with each other so as to form a complex instantaneously. In addition, the metachromasia phenomenon of a pigment is used for detecting the end point of titration. The "colloid titration set" (manufactured by Dojindo Laboratories) can be used for the measurement of the degree of cationization for which the colloid titration method is used.

With regard to the weakly cationic compound, the mixed amount of the cellulose coagulant is preferably in a range of 10 parts by mass to 200 parts by mass, more preferably 20 parts by mass to 150 parts by mass, and still more preferably 30 parts by mass to 100 parts by mass with respect to 100 parts by mass of the microfibrous cellulose. When the mixed amount of the weakly cationic cellulose coagulant is less than 10 parts by mass, there is concern that the water-filtering properties may be deteriorated. Conversely, when the mixed amount exceeds 200 parts by mass, there is concern that the transparency may be deteriorated.

In the method for manufacturing a microfibrous cellulose composite sheet of the present invention, it is also possible to use a manufacturing apparatus having a squirting section in which, for example, a dispersion fluid including the microfiber as described in Japanese Patent Application No. 2009-173136 is ejected on the top surface of an endless belt, and the dispersion medium is squirted from the ejected dispersion fluid, thereby generating a web and a drying section in which the web is dried so as to generate a fiber sheet, in which the endless belt is disposed from the squirting section through the drying section, and the web generated in the squirting section is mounted on the endless belt and transported to the drying section.

Dehydration methods that are generally used for papermaking can be used as the dehydration method that can be used in the present invention, and a method in which the mixed fluid is dehydrated using a Fourdrinier, a cylinder mold, an inclined wire, or the like, and then dehydrated using a roll press is preferred. In addition, ordinary methods used for papermaking can be used as the drying method, and methods using, for example, a cylinder dryer, a Yankee dryer, hot air drying, or an infrared heater are preferred. Meanwhile, the drying temperature is preferably about 70° C. to 130° C.

Meanwhile, the porous base material that can be used as the wire during the dehydration includes wires used for ordinary papermaking. Preferred examples thereof include metal wires made of stainless steel, bronze, or the like, and plastic wires made of polyester, polyamide, polypropylene, polyvinylidene fluoride, or the like. In addition, a membrane filter, such as cellulose acetate-based materials, can also be used. The aperture size of the wire is preferably 0.2 μm to 200 μm, and more preferably 0.4 μm to 100 μm. When the aperture size is less than 0.2 μm, the dehydration rate is extremely slowed, which is not preferable. When the aperture size is larger than 200 μm, the yield rate of the microfibrous cellulose is degraded, which is not preferable.

In this case, the concentration of the mixed fluid is preferably 3% by mass or less, more preferably 0.1% by mass to 1% by mass, and particularly preferably 0.2% by mass to 0.8% by mass. When the concentration of the mixed fluid exceeds 3% by mass, the viscosity is too large, and there is a concern that handling may become difficult. The viscosity of the mixed fluid is preferably about 100 mPa·s to 5000 mPa·s with respect to the B-type viscosity.

The basis weight of the microfibrous cellulose composite sheet that is obtained in the present invention is preferably 0.1 $g/m^2$ to 1000 $g/m^2$, more preferably 1 $g/m^2$ to 500 $g/m^2$, and particularly preferably 5 $g/m^2$ to 100 $g/m^2$. When the basis weight is less than 0.1 $g/m^2$, the strength of the sheet becomes extremely weak, and continuous production becomes difficult. When the basis weight exceeds 1000 $g/m^2$, the dehydration takes an extremely long time, and the productivity is extremely degraded, which is not preferable.

The thickness of the microfibrous cellulose composite sheet that is obtained in the present invention is preferably 0.1 μm to 1000 μm, more preferably 1 μm to 500 μm, and particularly preferably 5 μm to 100 μm. When the thickness is less than 0.1 μm, the strength of the sheet becomes extremely weak, and the continuous production becomes difficult. When the thickness exceeds 1000 μm, the dehydration takes an extremely long time, and the productivity is extremely degraded, which is not preferable.

In the present invention, it can be considered that composite sheets are thermally compressed and laminated in order to produce a composite sheet laminate. In a case in which a laminate is formed through thermal compression, the adhesive force between the sheets becomes strong when the fraction of the polymer mixed in the composite sheet is high, and the fiber width of the microfibrous cellulose is small. The mixed amount of the polymer is preferably 30% by mass or more, more preferably 35% by mass or more, and particularly preferably 40% by mass or more. When the mixed amount of the polymer is less than 30% by mass, there is a concern that the adhesive force by fusion of the polymer may be degraded. In addition, the fiber width of the microfibrous cellulose is preferably 200 nm or less, more preferably 150 nm or less, and particularly preferably 100 nm or less. When the fiber width of the microfibrous cellulose exceeds 200 nm, the surface unevenness of the sheet of the microfibrous cellulose becomes large, and there is a concern that the adhesive force between the sheets may be degraded.

In addition, a method in which the polymer emulsion or the microfibrous cellulose-containing polymer emulsion is applied and compressed on at least a single surface of the composite sheet was studied. The kind of applying polymer is not particularly limited, but applying of the same kind of polymer as the polymer contained in the composite sheet is preferred from the standpoint of the adhesiveness of the sheet. Applying of the polymer emulsion enables the securement of a desired adhesive force between the sheets even in a case in which the composite sheet does not have 30% by mass or more of the polymer mixed therein or the fiber width of the microfibrous cellulose exceeds 200 nm.

The composite sheets could be laminated by applying the polymer emulsion or the microfibrous cellulose-containing polymer emulsion on at least a single surface of the composite sheet, and adhering, heating, and drying the undried composite sheets, but wrinkles were easily generated. Particularly, when the number of laminated composite sheets is increased, the sizes of wrinkles are increased.

Therefore, a laminate having no wrinkles and an excellent appearance could be obtained by applying, heating, and drying the polymer emulsion or the microfibrous cellulose-containing polymer emulsion on at least a single surface of the composite sheet, thereby thermally compressing the composite sheets provided with the polymer layer so as to manufacture the laminate.

In the present invention, the polymer emulsion-applied surfaces may be thermally compressed, and the polymer emulsion-applied surface and the non-applied surface of the composite sheet may be thermally compressed. In addition, two or more composite sheets may be thermally compressed at the same time.

In the present invention, the method for applying the polymer emulsion is not particularly limited, and an ordinary method, such as bar coating, die coating, curtain coating, air knife coating, blade coating, rod coating, Gravure coating, spray coating, size press coating, and gate roll coating, is used. The applied amount of the polymer emulsion is not particularly limited, but the applied amount is preferably 0.1 $g/m^2$ to 10 $g/m^2$, more preferably 0.2 $g/m^2$ to 5 $g/m^2$, and particularly preferably 0.5 $g/m^2$ to 3 $g/m^2$. When the applied amount is less than 0.1 $g/m^2$, there is a concern that the thermal compression properties may become insufficient, which is not preferable. When the applied amount exceeds 10 $g/m^2$, the content of the microfibrous cellulose is decreased, and the dimensional stability and the like are degraded, which is not preferable. Here, the heating and drying is preferably carried out at a temperature of 70° C. to 130° C. using the above well-known method.

Since the thermal compression temperature is dependent on the melting point or softening point of the polymer in the polymer emulsion, a temperature higher than the melting point or softening point is preferable. In addition, when the temperature exceeds 250° C., the cellulose is deteriorated, and becomes liable to be discolored, and therefore the temperature is preferably 250° C. or lower. More specifically, the temperature is preferably 100° C. to 250° C.

The thermal compression pressure is not particularly limited, but is preferably 1 $kg/cm^2$ to 100 $kg/cm^2$, more preferably 3 $kg/cm^2$ to 50 $kg/cm^2$, and still more preferably 5 $kg/cm^2$ to 30 $kg/cm^2$. When the thermal compression pressure is less than 1 $kg/cm^2$, there is a concern that the compression properties may become insufficient, and, when the thermal compression pressure exceeds 100 $kg/cm^2$, the structure of the composite sheet is collapsed, and there is a concern that degradation of the strength may be caused.

The thermal compression method is not particularly limited, but the hot press method, which is compression of flat sheets, or the roll method, which is thermal compression through nipping between a roll and a roll, is preferred. Particularly, since the roll method can be continuously treated, the roll method is a preferable embodiment.

The microfibrous cellulose composite sheet and the laminate of the microfibrous cellulose composite sheet, which are obtained in the present invention, may be treated through size pressing, coating, and the like in the post process in order to obtain the target properties.

The composite sheet manufactured by the present invention is a wrinkle-free, high-density sheet maintaining a high modulus of elasticity that is derived from cellulose. In addition, it becomes possible to provide a function of a polymer resin for improving water resistance or wet dimensional stability resistance to the cellulose sheet, which is originally weak to water or has dimensions significantly changed by the humidity.

In addition, the laminate of the composite sheet manufactured by the present invention is a wrinkle-free, high-density laminate maintaining a high modulus of elasticity that is derived from cellulose. In addition, it becomes possible to provide a function of water resistance, which is possessed by a polymer, to cellulose, which is originally weak to water. Furthermore, since the laminate of the composite sheet can be easily formed through thermal compression, the laminate of the composite sheet can be used as a variety of vessels, chassis of electrified products, such as a personal computer, a television, or a mobile phone, or structural members of automobiles, electric trains, bicycles, and the like.

EXAMPLES

Hereinafter, the present invention will be described in more detail with reference to examples, but the present invention is not limited thereto. In addition, the parts and % in the examples refer to parts by mass and % by mass respectively unless otherwise described.

<Method for Manufacturing a Cellulose Aqueous Suspension A>

LBKP pulp (manufactured by Oji Paper Co., Ltd.: moisture 53.0%, freeness 600 mLcsf) was added to water so that the pulp concentration became 1%, and the pulp was defibrated using a disintegrator.

A treatment was carried out once on the obtained pulp suspension using an ultra-fine friction grinder (product name: "SUPERMASSCOLLOIDER," manufactured by Masuko Sangyo Co., Ltd.). Furthermore, a treatment was carried out on the pulp suspension 10 times using a high-pressure impact disperser (product name: "ALTIMIZER," manufactured by Sugino Machine Limited), and a cellulose aqueous suspension was obtained. The fiber width of the cellulose fiber was 250 nm. Finally, the pulp concentration of the aqueous suspension was adjusted to 0.5%.

<Method for Manufacturing a Cellulose Aqueous Suspension B>

LBKP pulp (manufactured by Oji Paper Co., Ltd.: moisture 53.0%, freeness 600 mLcsf) was added to water so that the pulp concentration became 1%, and the pulp was defibrated using a disintegrator.

A treatment was carried out four times on the obtained pulp suspension using an ultra-fine friction grinder (product name: "SUPERMASSCOLLOIDER," manufactured by Masuko Sangyo Co., Ltd.). Furthermore, a treatment was carried out on the pulp suspension 20 times using a high-pressure impact disperser (product name: "ALTIMIZER," manufactured by Sugino Machine Limited), and a cellulose aqueous suspension was obtained. Finally, the pulp concentration of the aqueous suspension was adjusted to 0.5%, and a 20 kHz ultrasonic treatment was carried out. The fiber width of the obtained cellulose fiber was 30 nm.

Example 1

After the cellulose aqueous suspension A and a cationic polyurethane resin emulsion that was diluted to a concentration of 0.5% (product name: "SUPERFLEX 650" (average particle diameter: 0.01 μm), manufactured by Dai-ichi Kogyo Seiyaku Co., Ltd.) were mixed in the ratios as shown in Table 1, 1.58 parts of an aqueous solution of aluminum sulfate having a concentration of 0.3% was added, and stirred for 1 minute. The obtained mixed fluid was suctioned and dehydrated on a 508-mesh nylon sheet, and then dried using a cylinder dryer at 90° C. while being pressurized to 0.2 MPa, thereby producing a microfibrous cellulose composite sheet.

Addition of 10 parts to 30 parts of the cationic polyurethane resin emulsion made the specific tensile strength almost similar to or higher than the specific tensile strength in a case in which only the cellulose was contained, and, in addition, could improve the dimensional stability against humidity and the moisture prevention performance.

TABLE 1

| Cellulose type | | Cellulose aqueous suspension A | | | |
|---|---|---|---|---|---|
| Number of cellulose parts | | 100 | 90 | 80 | 70 |
| Number of polyurethane parts | | 0 | 10 | 20 | 30 |
| Basis weight | $g/m^2$ | 36.7 | 34.5 | 34.3 | 34.4 |
| Thickness | mm | 0.041 | 0.037 | 0.038 | 0.037 |
| Bulk density | $g/cm^3$ | 0.91 | 0.93 | 0.92 | 0.94 |
| Specific tensile strength | N · m/g | 84.5 | 89.9 | 93.3 | 84.3 |
| Fracture elongation | % | 3.78 | 2.55 | 3.15 | 2.94 |
| Modulus of tensile elasticity | GPa | 6.8 | 7.7 | 7.0 | 6.1 |
| Ratio of humidity expansion and contraction | % | 0.84 | 0.70 | 0.60 | 0.53 |
| Moisture permeability (converted value of 30 $g/m^2$) | $g/m^2 \cdot 24$ h | 3600 | 3200 | 2700 | 2200 |

Example 2

After the cellulose aqueous suspension B and an anionic polyethylene emulsion that was diluted to a concentration of 0.5% (product name: "E-2213" (average particle diameter: 0.07 μm), manufactured by Toho Chemical Industry Co., Ltd.) were mixed in the ratios as shown in Table 2, 1.58 parts of an aqueous solution of aluminum sulfate having a concentration of 0.3% was added, and stirred for 1 minute. The obtained mixed fluid was suctioned and dehydrated on a 508-mesh nylon sheet, and then dried using a cylinder dryer at 90° C. while being pressurized to 0.2 MPa, thereby producing a microfibrous cellulose composite sheet.

Addition of 10 parts to 30 parts of the anionic polyethylene emulsion made the specific tensile strength almost similar to or higher than the specific tensile strength in a case in which only the cellulose was contained, and, in addition, could improve the dimensional stability against humidity and the moisture prevention performance.

TABLE 2

| Cellulose type | | Cellulose aqueous suspension B | | | |
|---|---|---|---|---|---|
| Number of cellulose parts | | 100 | 90 | 80 | 70 |
| Number of polyethylene parts | | 0 | 10 | 20 | 30 |
| Basis weight | $g/m^2$ | 41.5 | 30.5 | 36.2 | 32.6 |
| Thickness | mm | 0.034 | 0.027 | 0.034 | 0.031 |
| Bulk density | $g/cm^3$ | 1.21 | 1.12 | 1.06 | 1.04 |
| Specific tensile strength | N · m/g | 98.8 | 95.1 | 110.5 | 85.9 |
| Fracture elongation | % | 4.80 | 5.37 | 6.27 | 5.04 |
| Modulus of tensile elasticity | GPa | 10.5 | 8.6 | 8.0 | 7.4 |
| Ratio of humidity expansion and contraction | % | 0.83 | 0.76 | 0.71 | 0.68 |
| Moisture permeability (converted value of 30 $g/m^2$) | $g/m^2 \cdot 24$ h | 3100 | 3000 | 2800 | 2700 |

Example 3

After the cellulose aqueous suspension B and an acid-denatured styrene-butadiene (SBR) copolymer latex that was diluted to a concentration of 0.5% (product name: "PYRA- TEX J9049," manufactured by Nippon A&L Inc., solid content: 49%, Tg: −40° C., particle diameter: 220 nm) were mixed in the ratios as shown in Table 3, 1.58 parts of an aqueous solution of aluminum sulfate having a concentration of 0.3% was added, and stirred for 1 minute. The obtained mixed fluid was suctioned and dehydrated on a 508-mesh nylon sheet, and then dried using a cylinder dryer at 90° C. while being pressurized to 0.2 MPa, thereby producing a microfibrous cellulose composite sheet.

Addition of 20 parts of the acid-denatured styrene-butadiene (SBR) copolymer emulsion made the specific tensile strength almost similar to or higher than the specific tensile strength in a case in which only the cellulose was contained, and, in addition, could improve the dimensional stability against humidity and the moisture prevention performance. In addition, when 40 parts to 60 parts of the styrene-butadiene (SBR) copolymer emulsion was mixed, the tensile strength was lower than that in a case in which only the cellulose was contained, but the dimensional stability against humidity and the moisture prevention performance could be improved.

TABLE 3

| Cellulose type | | Cellulose aqueous suspension B | | | |
|---|---|---|---|---|---|
| Number of cellulose parts | | 100 | 80 | 60 | 40 |
| Number of acid-denatured SBR | | 0 | 20 | 40 | 60 |
| Basis weight | $g/m^2$ | 35.6 | 34.0 | 33.6 | 33.6 |
| Thickness | mm | 0.040 | 0.045 | 0.040 | 0.043 |
| Bulk density | $g/cm^3$ | 0.89 | 0.75 | 0.84 | 0.78 |
| Specific tensile strength | N · m/g | 77.0 | 74.0 | 45.0 | 31.0 |
| Fracture elongation | % | 4.47 | 5.00 | 2.87 | 5.70 |
| Modulus of tensile elasticity | GPa | 8.3 | 6.7 | 5.3 | 3.9 |
| Ratio of humidity expansion and contraction | % | 0.86 | 0.65 | 0.57 | 0.49 |
| Moisture permeability (converted value of 30 $g/m^2$) | $g/m^2 \cdot 24$ h | 3800 | 2900 | 2000 | 1500 |

Example 4

After the cellulose aqueous suspension B and an anionic acryl-based emulsion that was diluted to a concentration of 0.5% (product name: "VONCOAT CP-6190," manufactured by DIC, solid content: 40%, Tg: 43° C., particle diameter: 100 nm) were mixed in the ratios as shown in Table 4, 1.58 parts of an aqueous solution of aluminum sulfate having a concentration of 0.3% was added, and stirred for 1 minute. The obtained mixed fluid was suctioned and dehydrated on a 508-mesh nylon sheet, and then dried using a cylinder dryer at 90° C. while being pressurized to 0.2 MPa, thereby producing a microfibrous cellulose composite sheet.

Addition of 20 parts of the anionic acryl-based emulsion made the specific tensile strength almost similar to or higher than the specific tensile strength in a case in which only the cellulose was contained, and, in addition, could improve the dimensional stability against humidity and the moisture prevention performance. In addition, when 40 parts to 60 parts of the anionic acryl-based emulsion was mixed, the tensile strength was lower than that in a case in which only the cellulose was contained, but the dimensional stability against humidity and the moisture prevention performance could be improved.

TABLE 4

| Cellulose type | | Cellulose aqueous suspension B | | | |
|---|---|---|---|---|---|
| Number of cellulose parts | | 100 | 80 | 60 | 40 |
| Number of acryl parts | | 0 | 20 | 40 | 60 |
| Basis weight | $g/m^2$ | 37.5 | 36.5 | 36.2 | 36.4 |
| Thickness | mm | 0.041 | 0.042 | 0.044 | 0.043 |
| Bulk density | $g/cm^3$ | 0.91 | 0.87 | 0.82 | 0.85 |
| Specific tensile strength | N · m/g | 80.0 | 82.0 | 60.0 | 42.0 |
| Fracture elongation | % | 5.10 | 5.00 | 4.40 | 4.10 |
| Modulus of tensile elasticity | GPa | 9.4 | 7.4 | 6.1 | 4.3 |
| Ratio of humidity expansion and contraction | % | 0.85 | 0.73 | 0.56 | 0.43 |
| Moisture permeability (converted value of 30 $g/m^2$) | $g/m^2 \cdot 24$ h | 3400 | 2900 | 2500 | 2100 |

Example 5

After the cellulose aqueous suspension B and an anionic polypropylene-based emulsion that was diluted to a concentration of 0.5% (product name: "HYTEC E-8045," manufactured by Toho Chemical Industry Co., Ltd. solid content: 25%, melting point: 156° C., particle diameter: 150 nm) were mixed in the ratios as shown in Table 5, 1.58 parts of an aqueous solution of aluminum sulfate having a concentration of 0.3% was added, and stirred for 1 minute. The obtained mixed fluid was suctioned and dehydrated on a 508-mesh nylon sheet, and then dried using a cylinder dryer at 90° C. while being pressurized to 0.2 MPa, thereby producing a microfibrous cellulose composite sheet.

Addition of 20 parts of the anionic polypropylene-based emulsion made the specific tensile strength almost similar to or higher than the specific tensile strength in a case in which only the cellulose was contained, and, in addition, could improve the dimensional stability against humidity and the moisture prevention performance. In addition, when 40 parts to 60 parts of the anionic acryl-based emulsion was mixed, the tensile strength was lower than that in a case in which only the cellulose was contained, but the dimensional stability against humidity and the moisture prevention performance could be improved.

TABLE 5

| Cellulose type | | Cellulose aqueous suspension B | | | |
|---|---|---|---|---|---|
| Number of cellulose parts | | 100 | 80 | 60 | 40 |
| Number of polypropylene parts | | 0 | 20 | 40 | 60 |
| Basis weight | $g/m^2$ | 37.2 | 37.5 | 37.4 | 37.1 |
| Thickness | mm | 0.042 | 0.042 | 0.045 | 0.043 |
| Bulk density | $g/cm^3$ | 0.85 | 0.89 | 0.83 | 0.86 |
| Specific tensile strength | N · m/g | 79.2 | 79.1 | 62.1 | 43.1 |
| Fracture elongation | % | 5.31 | 5.40 | 4.62 | 4.22 |
| Modulus of tensile elasticity | GPa | 8.9 | 7.3 | 6.0 | 4.4 |
| Ratio of humidity expansion and contraction | % | 0.84 | 0.76 | 0.58 | 0.44 |
| Moisture permeability (converted value of 30 $g/m^2$) | $g/m^2 \cdot 24$ h | 3200 | 2600 | 2200 | 1500 |

Example 6

After the cellulose aqueous suspension B and a cationic polyurethane emulsion that was diluted to a concentration of 0.5% (product name: "SUPERFLEX 650" (average particle diameter: 0.01 μm), manufactured by Dai-ichi Kogyo Seiyaku Co., Ltd.) were mixed so that the solid content ratio of cellulose to polyurethane became 50:50, 1.58 parts of an aqueous solution of aluminum sulfate having a concentration of 0.3% was added, and stirred for 1 minute. The obtained mixed fluid was suctioned and dehydrated on a 508-mesh nylon sheet, and then dried using a cylinder dryer at 90° C., thereby producing a microfibrous cellulose composite sheet (I) having a basis weight of 80 g/m$^2$.

Two of the composite sheets (I) were overlapped and thermally compressed at 170° C. for 2 minutes (with a pressure of 10 kg/cm$^2$), thereby producing a laminate of the microfibrous cellulose composite sheet having a basis weight of 161 g/m$^2$.

Example 7

After the cellulose aqueous suspension A and a cationic polyurethane emulsion that was diluted to a concentration of 0.5% (product name: "SUPERFLEX 650" (average particle diameter: 0.01 μm), manufactured by Dai-ichi Kogyo Seiyaku Co., Ltd.) were mixed so that the solid content ratio of cellulose to polyurethane became 90:10, 1.58 parts of an aqueous solution of aluminum sulfate having a concentration of 0.3% was added, and stirred for 1 minute. The obtained mixed fluid was suctioned and dehydrated on a 508-mesh nylon sheet, and then dried using a cylinder dryer at 90° C., thereby producing a microfibrous cellulose composite sheet (II) having a basis weight of 80 g/m$^2$.

The cationic polyurethane emulsion that was diluted to a concentration of 10% (product name: "SUPERFLEX 650" (average particle diameter: 0.01 μm), manufactured by Dai-ichi Kogyo Seiyaku Co., Ltd.) was applied on a single surface of the composite sheet (II) using a bar coater, and dried at 105° C., thereby forming a polyurethane layer having a applied amount of 1 g/m$^2$ (this will be referred to as the composite sheet (III)). A single surface of the separately prepared composite sheet (II) and the surface of the polyurethane layer were overlapped and thermally compressed at 170° C. for 2 minutes (with a pressure of 10 kg/cm$^2$), thereby producing a laminate of the microfibrous cellulose composite sheet having a basis weight of 161 g/m$^2$.

Example 8

Five of the composite sheets (III) of Example 7 were overlapped so that the surface of the polyurethane layer and the surface on which the polyurethane layer was not formed were brought into contact with each other, and thermally compressed at 170° C. for 5 minutes (with a pressure of 10 kg/cm$^2$), thereby producing a laminate of the microfibrous cellulose composite sheet having a basis weight of 404 g/m$^2$.

Example 9

A microfibrous composite sheet (IV) having a basis weight of 80 g/m$^2$ was obtained in the same manner as in Example 7 except that the polyethylene emulsion (product name: "E-2213," manufactured by Toho Chemical Industry Co., Ltd.) was used.

The polyethylene emulsion that was diluted to 10% (product name: "E-2213," manufactured by Toho Chemical Industry Co., Ltd.) was applied on a single surface of the composite sheet (IV) using a bar coater, and dried at 105° C., thereby forming a polyethylene layer having a applied amount of 1 g/m$^2$ (this will be referred to as the composite sheet (V)). 15 of the composite sheets (V) were overlapped so that the surface of the polyethylene layer and the surface on which the polyethylene layer was not formed were brought into contact with each other, and thermally compressed at 170° C. for 15 minutes (with a pressure of 10 kg/cm$^2$), thereby producing a laminate of the microfibrous cellulose composite sheet having a basis weight of 1214 g/m$^2$.

TABLE 6

| | Polymer | Cellulose/polymer mixing ratio | Basis weight of laminate (g/m$^2$) | Tensile rupture strength (MPa) | Modulus of tensile elasticity (GPa) |
|---|---|---|---|---|---|
| Example 6 | Polyurethane | 50/50 | 161 | 85 | 5.1 |
| Example 7 | Polyurethane | 90/10 | 161 | 140 | 8.7 |
| Example 8 | Polyurethane | 90/10 | 404 | 138 | 9.0 |
| Example 9 | Polyethylene | 90/10 | 1214 | 144 | 8.9 |

<Evaluation Method>

1. Tensile Test

Tensile tests were carried out according to JIS P 8113: 1998. The tests were carried out with a span length of 100 mm and a tensile rate of 10 mm/min 2. Measurement of Humidity Expansion and Contraction Humidity expansion and contraction tests were carried out using a humidity expansion and contraction measuring apparatus of Sagawa Manufacturing Inc. While a load was applied using a 20 g weight, the humidity in a chamber was supplied with a humidity history of (a) 50% RH, (b) 85% RH, (c) 25% RH, (d) 85% RH, and (e) 25% RH, and then sequentially changed to 80% RH and 25% RH. The amounts of expansion and contraction at 80% RH and 25% RH were measured, and the ratio of humidity expansion and contraction was computed from the following formula.

Ratio of humidity expansion and contraction (%)=(the amount of expansion and contraction at a humidity of 80% RH−the amount of expansion and contraction at a humidity of 25% RH)/the span length×100

3. Water Vapor Transmission Rate

The water vapor transmission rate was measured according to the condition B of the testing method for determination of the water vapor transmission rate of moisture-proof packaging materials (dish method) of JIS Z 0208:1976. Since each of the sheets had a different basis weight, the water vapor transmission rate was obtained by converting the measured value to a value of 30 g/m$^2$ sheet under an assumption that the water vapor transmission rate is in proportion with the basis weight.

As is clear from Tables 1 to 5, according to the method for manufacturing a microfibrous cellulose composite sheet of the present invention, a composite sheet can be easily manufactured using a papermaking apparatus, and a composite sheet having improved dimensional stability against humidity and moisture prevention performance, and, furthermore, high specific tensile strength can be obtained.

In addition, as is clear from Table 6, according to the method for manufacturing a microfibrous cellulose composite sheet laminate of the present invention, a composite sheet laminate can be easily manufactured, and a composite sheet laminate having a high tensile rupture strength and a high modulus of tensile elasticity can be obtained.

INDUSTRIAL APPLICABILITY

According to the manufacturing method of the present invention, it is possible to efficiently manufacture a composite sheet of microfibrous cellulose, and the obtained sheet also shows excellent characteristics in terms of the strength, the dimensional stability against humidity, and the moisture prevention performance. Furthermore, the composite sheets can be laminated by thermally compressing the composite sheets as they are or provided with a polymer layer on at least one surface thereof, and the obtained composite sheet laminate also shows excellent characteristics in terms of the strength.

What is claimed is:

1. A method of manufacturing microfibrous cellulose composite sheet laminate comprising:

mixing a polymer emulsion with an aqueous suspension including microfibrous cellulose so as to manufacture a mixed fluid;

dehydrating the mixed fluid on a porous base material through filtration, wherein a sheet including moisture is formed; and drying and heating the sheet including moisture so as to obtain a microfibrous cellulose composite sheet;

overlapping two or more of the microfibrous cellulose composite sheets;

thermally compressing the overlapped microfibrous cellulose composite sheets; and providing a polymer layer on at least one surface of at least one of the microfibrous cellulose composite sheets, wherein the polymer layer has the same composition as the polymer emulsion contained in the microfibrous cellulose composite sheet.

2. The method of manufacturing microfibrous cellulose composite sheet laminate according to claim 1, wherein a solid content concentration of the mixed fluid is 3% by mass or less.

3. The method of manufacturing microfibrous cellulose composite sheet laminate according to claim 1, wherein the polymer emulsion is formed of at least one polymer selected from the group consisting of polyurethane, polyethylene, alkyl(meth)acrylate ester copolymers, acid-denatured styrene-butadiene copolymers, and polypropylene.

4. The method of manufacturing microfibrous cellulose composite sheet laminate according to claim 1, wherein the polymer emulsion is cationic.

5. The method of manufacturing microfibrous cellulose composite sheet laminate according to claim 1, wherein a cellulose coagulant is mixed in the mixed fluid comprising microfibrous cellulose.

6. The method of manufacturing microfibrous cellulose composite sheet laminate according to claim 1, wherein a fiber width of the mixing microfibrous cellulose is 2 nm to 1000 nm.

7. A method of manufacturing a microfibrous cellulose composite sheet laminate comprising:

mixing a polymer emulsion with an aqueous suspension including microfibrous cellulose so as to manufacture a mixed fluid;

dehydrating the mixed fluid on a porous base material through filtration, wherein a sheet including moisture is formed; and drying and heating the sheet including moisture so as to obtain a microfibrous cellulose composite sheet;

overlapping two or more of the microfibrous cellulose composite sheets;

thermally compressing the overlapped microfibrous cellulose composite sheets; and providing a polymer layer on at least one surface of at least one of the microfibrous cellulose composite sheets, wherein the polymer layer is obtained by applying, heating, and drying the polymer emulsion.

8. The method of manufacturing microfibrous cellulose composite sheet laminate according to claim 7, wherein a solid content concentration of the mixed fluid is 3% by mass or less.

9. The method of manufacturing microfibrous cellulose composite sheet laminate according to claim 7, wherein the polymer emulsion is formed of at least one polymer selected from the group consisting of polyurethane, polyethylene, alkyl(meth)acrylate ester copolymers, acid-denatured styrene-butadiene copolymers, and polypropylene.

10. The method of manufacturing microfibrous cellulose composite sheet laminate according to claim 7, wherein the polymer emulsion is cationic.

11. The method of manufacturing microfibrous cellulose composite sheet laminate according to claim 7, wherein a cellulose coagulant is mixed in the mixed fluid comprising microfibrous cellulose.

12. The method of manufacturing microfibrous cellulose composite sheet laminate according to claim 7, wherein a fiber width of the mixing microfibrous cellulose is 2 nm to 1000 nm.

* * * * *